United States Patent [19]

Thorbjörnsson et al.

[11] Patent Number: 4,688,301

[45] Date of Patent: Aug. 25, 1987

[54] METHOD AND APPARATUS FOR FORMING A WEB

[75] Inventors: Sven-Ingvar Thorbjörnsson, Karlstad; Lars-Otto Sislegård, Kil, both of Sweden

[73] Assignee: Sunds Defibrator AB, Sundsvall, Sweden

[21] Appl. No.: 860,130

[22] Filed: May 6, 1986

[30] Foreign Application Priority Data

May 8, 1985 [SE] Sweden ..... 8502260

[51] Int. Cl.[4] ..... D01G 25/00

[52] U.S. Cl. ..... 19/296; 19/304; 19/300

[58] Field of Search ..... 19/296, 300, 301, 302, 19/303, 304, 305; 264/518

[56] References Cited

U.S. PATENT DOCUMENTS

| | | | |
|---|---|---|---|
| 3,071,822 | 1/1963 | Meiler | 19/302 X |
| 4,091,161 | 5/1978 | Desverchere | 19/304 X |
| 4,099,290 | 7/1978 | Gustavsson | 19/304 |
| 4,099,296 | 7/1978 | Gustavsson | 19/304 |
| 4,543,690 | 10/1985 | Potters | 19/300 |

*Primary Examiner*—Louis K. Rimrodt
*Assistant Examiner*—J. L. Olds
*Attorney, Agent, or Firm*—Bell, Seltzer, Park & Gibson

[57] ABSTRACT

A method and apparatus for forming a web having a predetermined grammage profile in its transverse direction is provided. The method includes the steps of introducing a flow of particulate material into the distribution chamber of a forming head through an oscillating nozzle and depositing the material on an air permeable belt to form a web while changes in the upper surface of the web are detected downstream of the distribution chamber, signals are generated in response to any change which are compared with predetermined set points, and an output control signal is generated as a result of the comparison. The pattern of movement of the nozzle is controlled in response to the output control signal to provide the predetermined grammage profile for the web. In addition, the speed of the web may be measured and used to control the frequency of the nozzle so that a web having uniform grammage in the longitudinal direction is also provided. An apparatus for accomplishing each of the steps of the method is additionally provided.

11 Claims, 15 Drawing Figures

METHOD AND APPARATUS FOR FORMING A WEB

BACKGROUND OF THE INVENTION

The present invention relates to a method and apparatus for forming a web having a predetermined grammage profile in its transverse direction.

When forming a web of particulate material such as wood or synthetic fibers, it is known to use air to transport the particles in a forming head to an air-permeable wire on which the particulate material is collected and forms a web while the air passes through the web and the wire and is drawn off via a suction box by means of a slight subatmospheric pressure generated by a fan system. The wire is driven forward at a controlled speed so that a web having a certain weight per unit area is formed. In order to reduce variations in the grammage (i.e. weight per unit area) which may occur during forming, at least in the manufacture of thicker webs, a scalper roll is used which cuts excess material from the upper side of the web. The position of the scalper roll in relation to the wire can be controlled by measuring equipment located after the roll for measuring grammage. This equipment may comprise a weighing plate or some other type of grammage meter. This procedure enables a web to be produced with uniform grammage in its longitudinal direction.

Substantially uniform grammage is also desired in the transverse direction of the web. In certain cases it is even desirable to be able to vary the grammage across the web, the edge portions of the web having greater grammage than the central portion, for instance, since experience has shown that a certain squeeze effect will occur at the edge portions of the web during subsequent treatment of the web. In the manufacture of fiberboard, for instance, air is squeezed out from the edge portions in the subsequent belt pre-compression and hot compression steps. If the web has been formed with suitably increased grammage in the edge portions, the final result will then be that the finally pressed board will be substantially uniform in grammage and density transverse to the direction of forming, which is important if it is to be acceptably strong at the edge portions. A web with initially uniform grammage in its cross direction, though, will have lower grammage and density at the edge portions in the final board. The edge portions of the board will therefore have low strength properties. The properties of the edge portions will determine if the product is to be classed as first or second quality. Therefore, the choice is between increasing the average grammage in order to obtain acceptable properties in the edge portions, or sawing off the unacceptable part of the edge portions. Both alternatives result in extra material consumption and increased manufacturing costs.

To control the grammage across the web, it is known when using air carried fibers to give the fiber flow entering the distribution chamber of the forming head an oscillating movement transverse to the direction of movement of the web. This oscillation can be achieved either mechanically as is described in U.S. Pat. No. 3,071,822 or pneumatically as described in U.S. Pat. No. 4,099,296 (substantially corresponding to SE No. 7510795-3).

The distribution of fibers across the web in apparatuses using pneumatically controlled fiber distribution has not been satisfactory in that it has been necessary in practice to apply rolls or loaded sliding shoes to press down the edge portions of the fiber web in an attempt to achieve increased grammage at the edge portions. The use of rolls or sliding shoes has considerable drawbacks. For one thing, the load distribution must be varied for varying grammage in order to achieve an acceptable result, and for another, there is a considerable risk that the upper surface of the fiber web will be rolled up, roughened or otherwise destroyed.

Apparatuses using mechanically controlled fiber distribution such as the apparatus described in the aforementioned patent do not succeed in achieving the desired grammage profile across the web and there, too, it has been necessary in practice to use rolls (or sliding shoes similar to those described above, in order to improve the result.

In other applications it has been necessary to camber the scalper roll to a certain extent in order to at least improve the grammage profile across the width of the web. This has the obvious drawback that the desired grammage profile across the width of the web can only be obtained at a nominal grammage.

In apparatuses using mechanical oscillation, control systems are known having a hydraulic cylinder with simple hydraulics and with mechanically actuated limit positions defining the end positions of the oscillation. Such an apparatus has considerable limitations in controlling the particulate flow in the direction transverse of the direction of movement of the web, thus preventing the desired variation in grammage across the web.

The object of the invention is to minimize the problems mentioned above and to provide a method and an apparatus for forming a web in such a manner and using such means that a predetermined grammage profile can be continuously obtained, so that desired variations in grammage across the web can be controlled and adjusted automatically in a reliable manner.

SUMMARY OF THE INVENTION

The invention relates to a method of forming a web having a predetermined grammage profile in its transverse direction, comprising the steps of introducing a composite flow of particulate material suspended in air into the distribution chamber of a forming head through an oscillating nozzle, depositing the material onto the upper surface of an air permeable belt moving through the distribution chamber to form a web on a surface of the belt, and controlling the grammage profile automatically by detecting changes in the upper surface of the web downstream of the distribution chamber and generating signals in response to any such change, comparing the signals with set point signals, and generating an output control signal, and controlling the pattern of movement of the oscillating nozzle in response to the output control signal so that the particulate material is distributed over the belt while forming a web having the predetermined grammage profile in its transverse direction.

According to a preferred embodiment of the invention the frequency of the nozzle is also controlled by means of measured value signals from sensors imparting information as to the speed of the wire, in order to achieve a web having a uniform grammage profile in its longitudinal direction.

The invention also relates to an apparatus for forming a web having a predetermined grammage profile in its transverse direction, said apparatus comprising a forming head with a distribution chamber, a nozzle through which particulate material suspended in air is introduced into the distribution chamber and deposited onto a horizontal air permeable belt mounted for movement through the distribution chamber, and a feedback control system including nozzle oscillating means for oscillating the nozzle, web sensor means downstream of the distribution chamber for detecting changes in the upper surface of the web and for generating signals in response to any change, controller means for comparing the signals with set point signals and for generating an output control signal, and oscillator control means actuated by control signals from the controller means for controlling the pattern of movement of the nozzle so that the particulate material is distributed over the belt to form a web having the predetermined grammage profile in its transverse direction.

DESCRIPTION OF THE DRAWINGS

The invention will be described further in the following detailed description with reference to the accompanying drawings in which.

DETAILED DESCRIPTION OF THE PREFERRED EMBODIMENT

Figure 1:
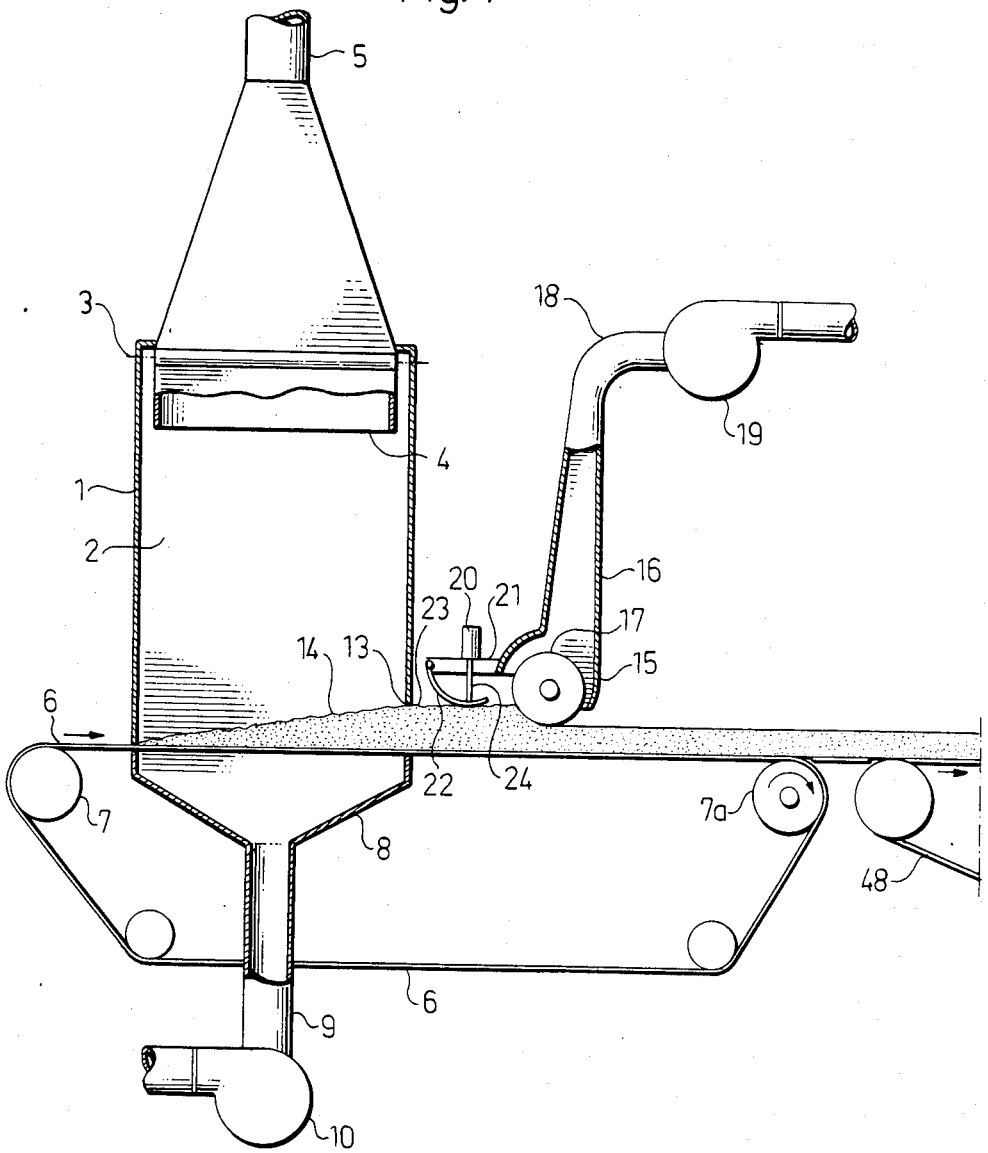
FIG. 1 is a side view schematic of an apparatus for forming a web according to an embodiment of the invention.
Figure 2:
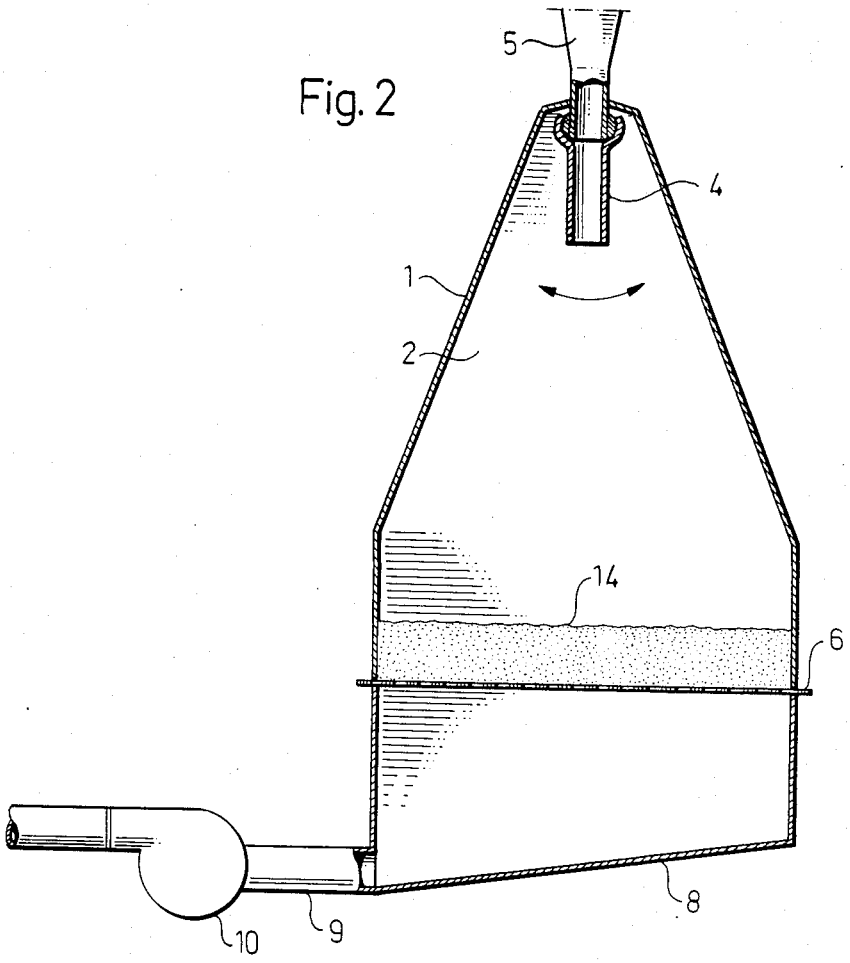
FIG. 2 shows a vertical cross section through the forming head of the apparatus according to FIG. 1.

With reference to FIG. 1 it is schematically shown therein parts of an apparatus for forming a web of a particulate material such as wood or synthetic fibers, said apparatus comprising a forming head 1 with distribution chamber 2 and a nozzle 4 oscillating about a shaft 3 and with its orifice positioned in the upper part of the distribution chamber 2 and communicating with a container (not shown) via a supply pipe 5 for supplying the particulate material in a carrier air stream.

An air permeable endless belt or wire 6 runs in a loop around a plurality of rolls 7, the, roll 7*a* being the driving one. The wire 6 is arranged to run horizontally through the distribution chamber 2, with its surface exposed in order to continuously receive particles flowing down through the distribution chamber 2. The forming head 1 also includes a suction box 8 located below the wire 6 and the distribution chamber 2, with which the suction box 8 is aligned. The suction box 8 has an outlet 9 with fan 10 arranged to generate a suitable subatmospheric pressure in the suction box 8 to remove the carrier air drawn into the suction box 8 from the distribution chamber 2 through the wire 6.

As seen in FIG. 1, the distribution chamber 2 has a horizontal outlet 13 in connection to the wire 6 through which the wire 6 and web 14 of particulate material formed thereon pass.

The apparatus shown in FIG. 1 is also provided with an adjustment means 15 located downstream of the forming head 1 and including a hood 16 fitted above the wire with a horizontally rotating scalper roll 17, arranged at a predetermined distance from the wire 6 in order to cut excess material from the web 14 passing beneath the roll 17. The hood 16, forming a vertically movable unit with the scalper roll 17, communicates by way of a sliding connection with an upper outlet 18 in which a fan 19 is arranged to suck off the excess material removed by the scalper roll 17. Between the forming head 1 and the adjustment means 15 are web sensor means depicted as three sensors 20 for level measurements, distributed across the width of the web 14 and secured to the hood 16 by support arms 21. Each sensor 20 is provided with a pivotable element 22, arranged to lie in contact with the web 14 to sense the level of the upper surface 23 of the web 14 in relation to a reference plane, and thus react to any changes in this level. These changes are recorded in a suitable manner via a connecting arm 24. Said recorded levels thus form the thickness profile of the web 14 prior to contacting the scalper roll 17. Signals from all three sensors 20 are processed and the average value is compared with a set point for the desired thickness of the web 14. When differences are recorded, signals are generated which actuate the discharge of particulate material supplied from a store (not shown), the amount of particles supplied to the distribution chamber 2 increasing or decreasing depending on the value of the control signal, until the desired thickness is set on the web.

When the web 14 has passed the adjustment means 15 it is transferred from the wire 6 to a conveyor belt 48 of a subsequent pressing station.

The grammage profile transverse to the longitudinal direction or direction of movement of the web 14 is primarily controlled by the pattern of movement for the oscillating nozzle 4, as will be explained below.

Figure 3:
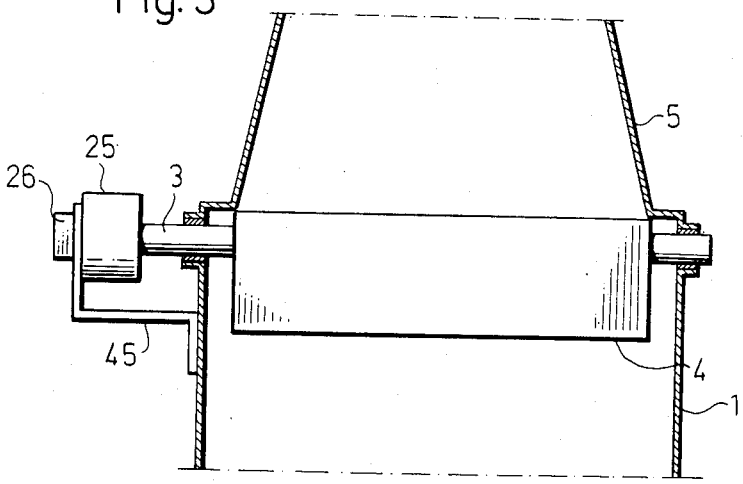
FIG. 3 is a side view schematic depicting an oscillating nozzle in the apparatus according to FIG. 1, including means for oscillating the nozzle.

FIG. 3 depicts an embodiment of a nozzle oscillating means in the form of a double-action hydraulic turning piston device 25 which is mounted on a bracket 45 secured to the forming head 1 and arranged to encompass and cooperate with shaft 3 to turn the shaft 3 backwards and forwards with equivalent oscillation of the nozzle 4. Nozzle position sensor means 26 is arranged close to the shaft 3 to indicate the angle position of the shaft 3 and in turn the nozzle 4. A linear position indicator with associated lever may alternatively be used for this indication.

Figure 4:
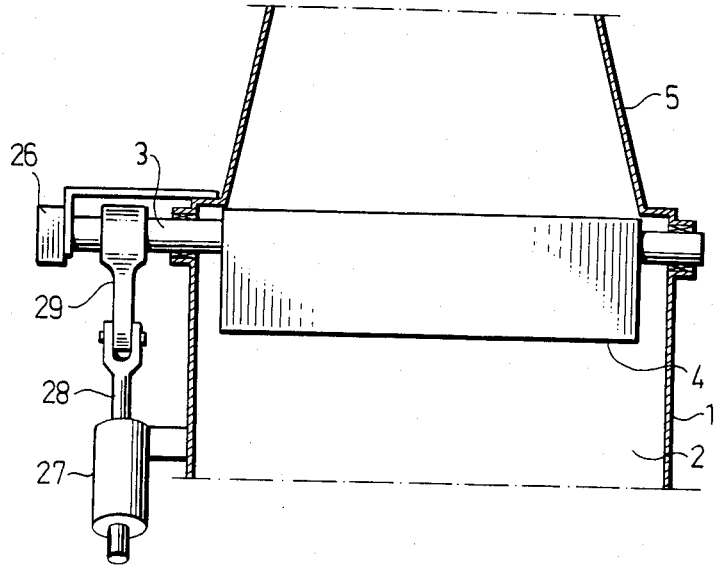
FIG. 4 is a side view schematic of the oscillating nozzle depicting an alternative form for the means for oscillating the nozzle.

FIG. 4 depicts an alternative embodiment of the nozzle oscillating means for driving the nozzle 4. In this embodiment a hydraulic cylinder 27 is used, which is articulately attached to the forming head and preferably has a through piston rod 28 which angularly activates a lever 29 rigidly attached to the shaft 3. As in the embodiment first described, suitable nozzle position sensor means 26 is provided to indicate the angle position of the shaft 3.

Figure 5:
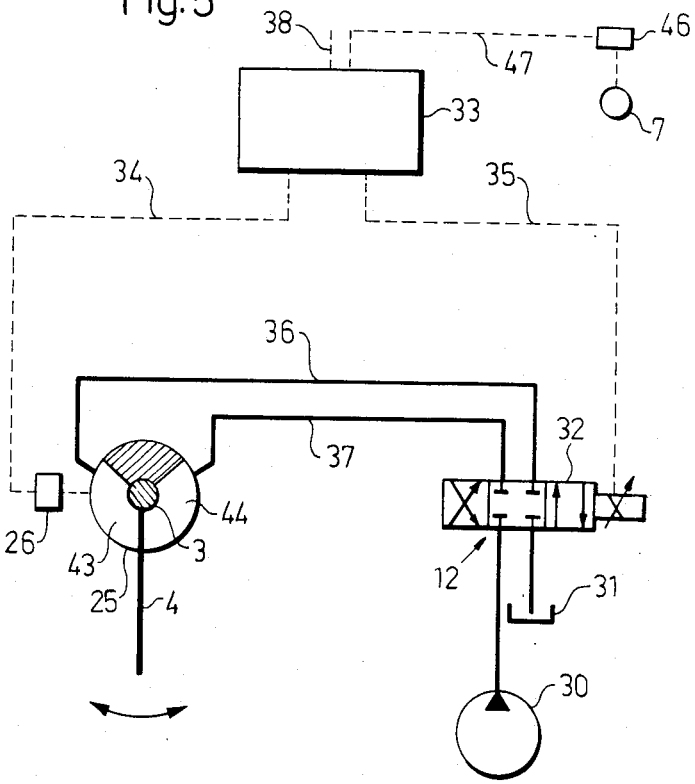
FIG. 5 is a schematic view of a feedback control system for automatically controlling the position of the nozzle in the apparatus according to FIG. 1.

The nozzle oscillating means forms part of a special feedback control system for automatically controlling the oscillation pattern of the nozzle 4 depending on certain operating parameters. FIG. 5 depicts a form of such a control system which includes nozzle oscillating means 25 according to FIG. 3, oscillator control means comprising a hydraulic setting device 12, and controller means 33 preferably equipped with a closed electronic control system. The hydraulic setting device 12 is provided with a hydraulic pump 30 and a tank 31 to serve a servo-valve 32. The hydraulic setting device 12 also includes other hydraulic components of known construction, such as an overflow valve, filter, and an accumulator to absorb pressure shocks, etc. The closed electronic control system of controller means 33 comprises an electronic unit connected by wires 34 and 35 to the sensor 26 and servo-valve 32 of setting device 12, respectively. The electronic control system of controller means 33 actuates the servo-valve 32 and is arranged to regulate the pattern of movement, acceleration and speed of the nozzle 4. The servo-valve 32 is in connection with two pressure chambers 43, 44 of the nozzle oscillating means 25 via hydraulic conduits 36, 37, respectively. The hydraulic conduits 36, 37 between servo-valve 32 and nozzle oscillating means 25 should be as short as possible to give the control system high rigidity. Accordingly, the servo-valve 32 is preferably mounted directly on the nozzle oscillating means 25.

The electronic control system of controller means 33 operates with a closed control circuit in which a signal concerning the current angular position of shaft 3 and nozzle 4 is continuously reported via wire 34 from the nozzle position sensor means 26 and compared with a set point in the electronic equipment of controller means 33. The difference signal is processed therein and results in an output control signal which is transmitted via wire 35 to the servo-valve 32 of the hydraulic setting device 12 in order to correct this. The set point may consist of information programmed in earlier as control sequences in the electronic equipment, an external control signal transmitted via a wire 38, or a combination of these.

Figure 6:
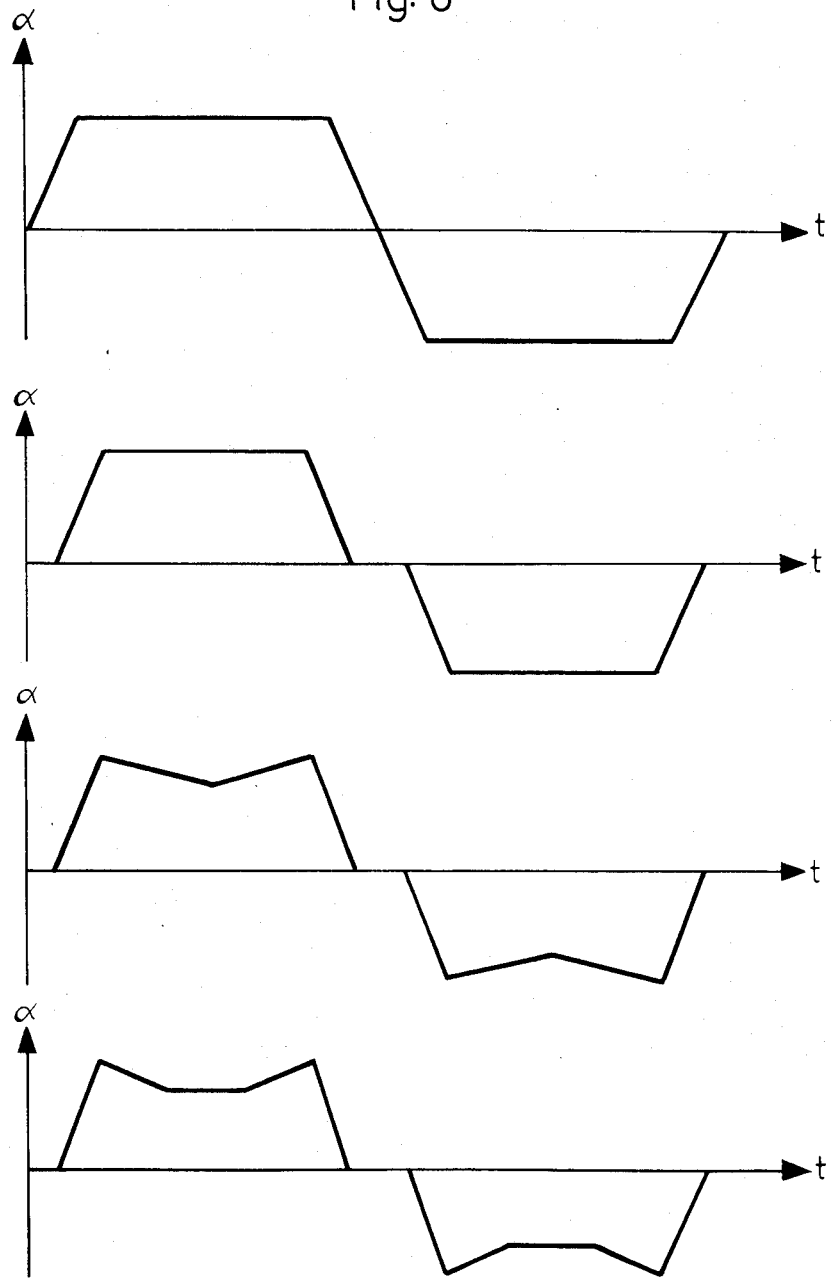
FIG. 6 shows four different examples of control sequences which can be pre-programmed and selected in an electronic control system according to the invention.

FIG. 6 shows four different examples of control sequences which can be programmed in advance in controller means 33 and selected. The x-axis indicates time and the y-axis the deflection angle $\alpha$ of the nozzle from neutral or central position. All the examples show that the nozzle is imparted a pattern of movement which includes a dwell time at the opposite turning positions of the nozzle. With the exception of the first example, there is also a period of rest in the neutral position of the nozzle between the two turning positions. Other control sequences may be used if desired.

The use of the feedback control system according to the invention enables oscillation of the nozzle 4 to be controlled in such a manner that a desired grammage profile across the width of the web is achieved. The closed control system with servo-valve 32 and electronic equipment of controller means 33 permits an extremely accurate control of the movement of the oscillating nozzle 4 and it is thus possible to achieve a desired variation in grammage as mentioned in the introduction, i.e. the edge portions having higher grammages than central portions of the web so that a uniform grammage profile in transverse direction is obtained in the finished web of material after pressing.

When three sensors 20 are used as a web sensing means for level measurements as in the embodiment shown in FIG. 1, the following control signals can be generated and transmitted to the electronic equipment of the controller 33 via the wire 38.

EXAMPLE 1

The signal from the righthand sensor 20 is compared with the signal from the lefthand sensor 20 seen in the direction of movement of the web. In the event of a difference between the signals from the two measuring points, e.g. the signal from the righthand sensor is larger than that from the lefthand sensor seen in the direction of movement of the web, this difference signal will be processed in the electronic equipment of the controller 33 and passed on to the servo-valve 32 as a control signal to move the entire pattern or schedule of movement of the nozzle 4 slightly further to the left until an equalization has occurred and, thus, the difference signal has become zero.

EXAMPLE 2

The average value of the signals from the righthand sensor 20 and the lefthand sensor 20 is compared with the signal from the middle sensor 20. In the event of a difference between these values, e.g. because there is too much material in the edge portions of the web, the angle $\alpha$ of deflection of the nozzle or alternatively the period of rest of the nozzle in or at the end positions may be decreased by the nozzle oscillating means in accordance with a selection programmed in advance until the web acquires the correct grammage profile.

With aid of the feedback control system according to the present invention it is also possible to control the oscillation frequency of the nozzle 4 so that it matches the speed of the wire 6 in order to achieve a desired uniform grammage profile in the longitudinal direction of the web as well. The control system then includes a sensor 46 which, via a wire 47, transmits information as to the speed of the wire 6. The sensor 46 may, for instance, sense the speed of rotation of a roller 7 about which the wire 6 runs, and emit measured value signals to the controller 33. The frequency of the nozzle 4 is then controlled by actuation of the servo-valve 32 and the nozzle oscillating means 25.

Figure 7A:
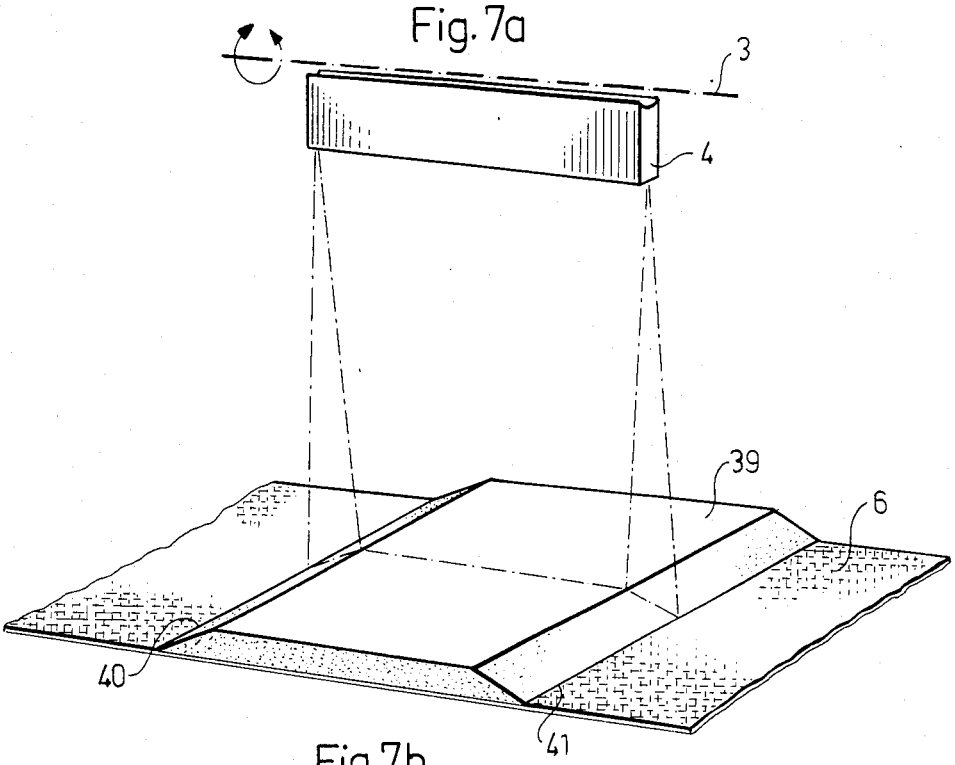
FIGS. 7*a* and 7*b* are schematic views depicting parts of the nozzle and wire in perspective from the side.
Figure 7B:
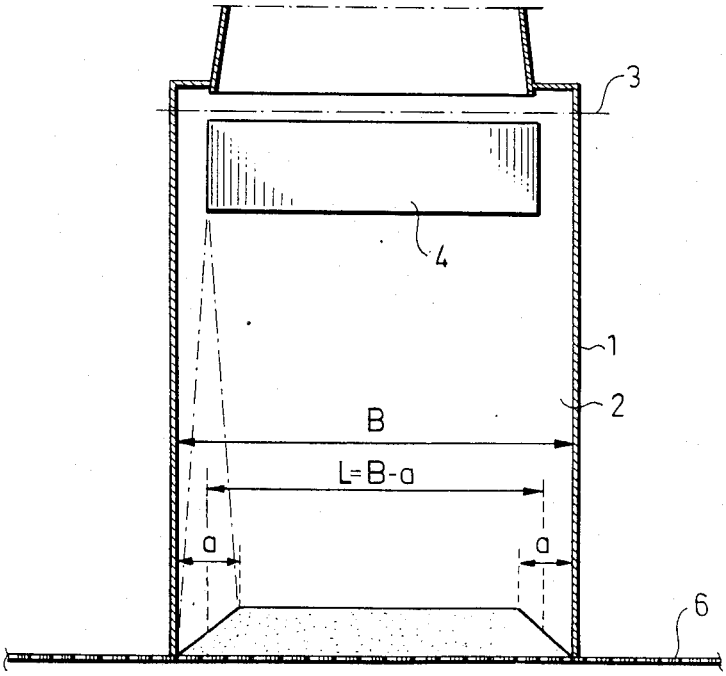

FIGS. 7*a* and 7*b* illustrate the distribution area of the nozzle 4 if the wire 6 were stationary. When the nozzle has completed a full oscillation movement, a layer 39 of the web will have been built up. Due to the fact that the nozzle is somewhat shorter than the length of the distribution chamber 2 in longitudinal direction of the wire 6 and due to the shape of the nozzle 4, an edge effect will be achieved so that the layer 39 will have a decreasing thickness to zero in the direction towards the edges 40, 41.

Figure 8:
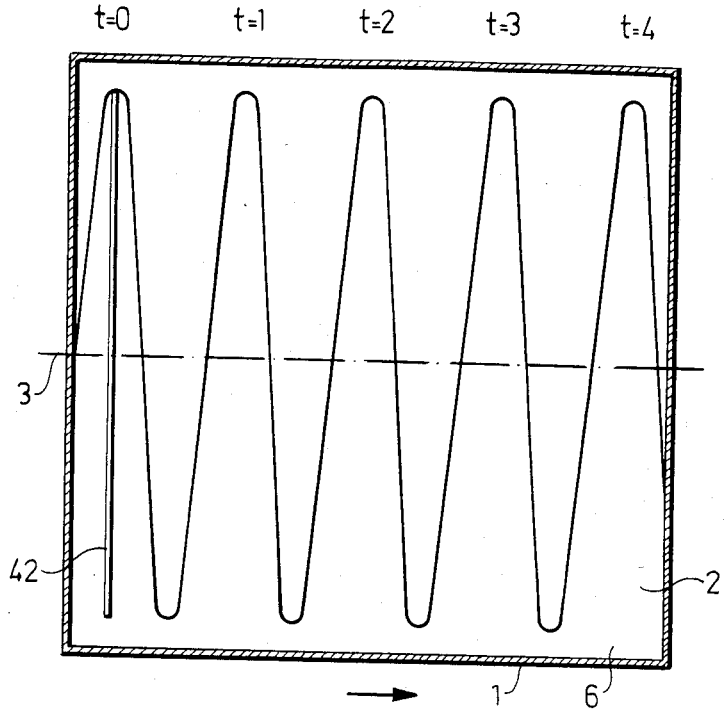
FIG. 8 is a top schematic view of the distribution chamber and wire depicting the movement of the nozzle across the forming web.

FIG. 8 illustrates the distribution chamber 2 and wire 6 seen from above. If a rod or line 42 is imagined lying transversely to the direction of movement of the wire 6, and this rod is allowed to accompany the wire 6 through the distribution chamber 2, the nozzle 4 will reach its lefthand end position five times during passage of the rod through the distribution chamber at a certain speed of the wire 6 and certain oscillation frequency of the nozzle 4. At each moment when the nozzle reaches this end position, i.e. t=0, 1, 2, 3 and 4, a new layer of particles has been deposited at this end position of the nozzle on the layer already deposited, starting from one end of the imaginary rod 42 and back to this one end.

Figure 9A:
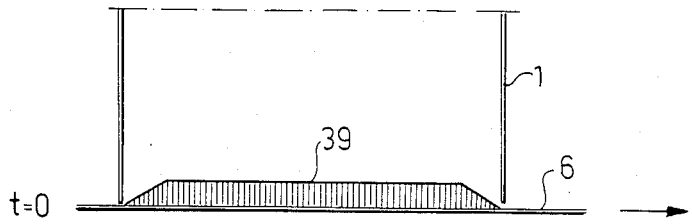
FIGS. 9*a*, 9*b*, 9*c*, 9*d* and 9*e* are side view schematics illustrating the precipitation of layers of particles during movement of the wire through the distribution chamber, FIGS. 9*b*–9*e* showing the result if the speed of the wire and the frequency of the nozzle are not adjusted to each other.
Figure 9B:
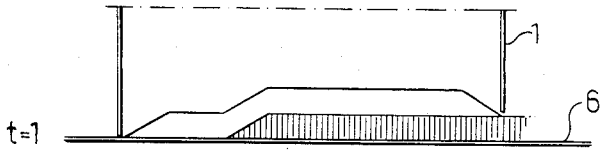
Figure 9C:
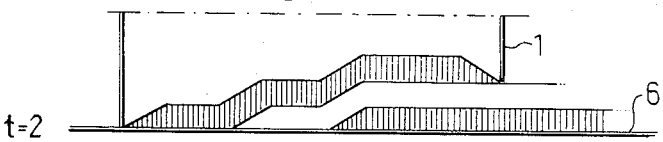
Figure 9D:
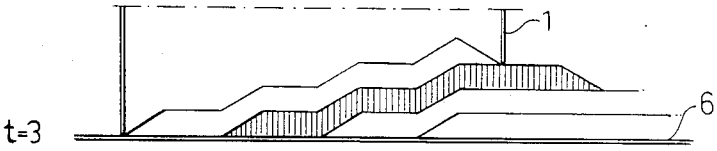
Figure 9E:
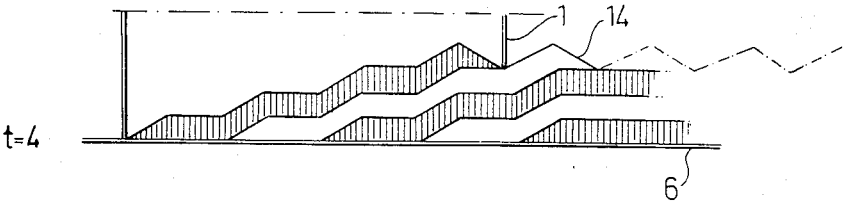

FIGS. 9*b*, 9*c*, 9*d* and 9*e* illustrate the deposition of layer after layer on the movable wire 6 counted from a starting position, t=0, according to FIG. 9*a* when a first layer 39 has already been deposited on the wire 6. FIGS. 9*b*, 9*c*, 9*d* and 9*e* then illustrate the formation of a web when the ratio between the wire speed and the nozzle frequency is not correctly adjusted, thereby resulting in an uneven grammage profile in the longitudinal direction (FIG. 9*e*).

Figure 10:
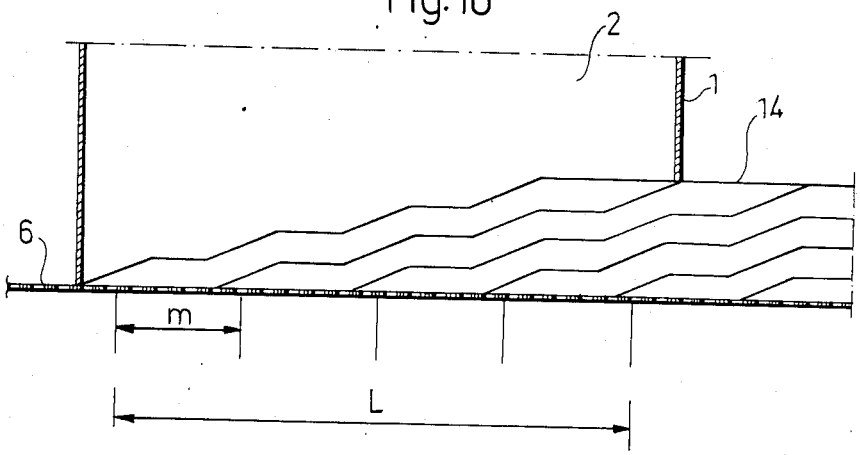
FIG. 10 illustrates a web formed when the speed of the wire and the frequency of the nozzle are matched to each other in accordance with the invention.

FIG. 10 illustrates a web formed in accordance with the present invention by matching the speed (v) of the wire 6 and frequency (f) of the nozzle 4 to each other so that a uniform grammage profile in longitudinal direction is achieved. The control system then includes a sensor 46 for the wire speed, as mentioned earlier.

If (B) in FIG. 7*b* denotes the length of the distribution chamber 2 along the wire 6, (a) is the length of the decreasing material area at each edge, (n) is the number of turning positions (on the same side of the neutral or middle position) of the nozzle 4 after a certain moment, (m) is the distance between two end positions, (L) is the distance between the first end position and the last end position, and (T) is the time for each oscillation, the following equations apply, whereby (v) (m/min) and (f) (osc/min) have the significance explained above:

$$L=B-a$$

$$m=L/n$$

$$T=m/v$$

$$F=1/T=v/m=n\cdot v/L$$

By forming a web of particulate material with uniform thickness in the longitudinal direction one obtains the essential advantage that the amount of excess material which is removed by the scalper roll can be reduced to a minimum. Recirculation of particles is thus reduced to the same extent. Furthermore, the most uniform grammage profile possible is achieved in longitudinal direction since the thickness of the web will be substantially constant so that the suction of air through the web will be uniform as seen in the longitudinal direction thereof (cf. FIGS. 9*e* and 10).

In the drawings and specification, there has been set forth a preferred embodiment of the invention, and although specific terms are employed, they are used in a generic and descriptive sense only and not for purposes of limitation.

That which is claimed is:

1. A method of forming a web having a predetermined grammage profile in its transverse direction comprising the steps of introducing a composite flow of particulate material suspended in air into the distribution chamber of a forming head through an oscillating nozzle having a pattern of movement along a path of travel, depositing the particulate material onto an air permeable belt moving through the distribution chamber in a direction transverse to the path of travel of said oscillating nozzle so as to form a web of particulate material on a surface of said belt, detecting changes in the upper surface of said web downstream of the distribution chamber and generating signals in response to any such change, comparing said signals with predetermined set points and generating an output control signal, and controlling the pattern of movement of said oscillating nozzle in response to said output control signal so that the particulate material is distributed over the permeable belt to form a web having a predetermined grammage profile.

2. A method of forming a web according to claim 1 wherein said step of generatng an output control signal comprises generating the output control signa using pre-programmed parameters of movement.

3. A method of forming a web according to claim 2 wherein the parameters for the pattern of movement of said oscillating nozzle include a predetermined dwell time at the turning position of the nozzle whereby the longitudinal edge portions of the formed web have a higher grammage than the central portion of the web.

4. A method according to claim 2 wherein the parameters for the pattern of movement of said oscillating nozzle include parameters for centering the nozzle, controlling the angle of deflection of the nozzle, and a period of rest for said nozzle along the pattern of movement.

5. A method of forming a web according to claim 1 further comprising the steps of measuring the speed of the air permeable belt and controlling the oscillation frequency of said oscillating nozzle in response to said speed measurement so as to provide a web having a uniform grammage profile in the transverse and longitudinal directions of the web.

6. A method of forming a web having a uniform grammage in the longitudinal direction of the formed web and comprising the steps of introducing a composite flow of particulate material suspended in air into the distribution chamber of a forming head through an oscillating nozzle having a pattern of movement along a path of travel, depositing the particulate material onto an air permeable belt moving through the distribution chamber in a direction transverse to the path of travel of said oscillating nozzle so as to form a web of particulate material on the surface of said belt, measuring the speed of said belt and controlling the frequency of said oscillating nozzle in response to said speed measurement so as to form a web having a uniform grammage profile in the longitudinal direction of the web.

7. A method of forming a web according to claim 6 wherein the frequency (f) of the oscillating nozzle is controlled in accordance with the equation $$f=n\cdot v/L$$

wherein n is the number of turning positions of the oscillating nozzle in a given moment, v is the speed of the air permeable belt and L is the length of the distribution chamber coinciding with the belt passing therethrough less the length of the decreasing material area at the edge of the web.

8. An apparatus for forming a web having a predetermined grammage profile in its transverse direction comprising a forming head having a distribution chamber, a nozzle for introducing a composite flow of particulate material suspended in air into the distribution chamber, a horizontally oriented air permeable belt mounted for movement through said distribution chamber and for receiving the particulate material introduced by said nozzle on a surface of said belt so as to form a web, nozzle oscillating means for oscillating said nozzle in a pattern of movement transverse to the direction of movement of said permeable belt, web sensor means downstream of said distribution chamber for detecting changes in the upper surface of said web and for generating signals in response to any such change, controller means for comparing said signals with predetermined set points and for generating an output control signal, and oscillator control means connected to said nozzle oscillating means and responsive to the output control signal generated by said controller means for controlling the pattern of movement of said nozzle so that the particulate material is distributed over the permeable belt to form a web having a predetermined grammage profile.

9. An apparatus for forming a web having a predetermined grammage profile in its transverse direction comprising a forming head having a distribution chamber, a nozzle for introducing a composite flow of particulate material suspended in air into the distribution chamber, a horizontally oriented air permeable belt mounted for movement through said distribution chamber and for receiving the particulate material introduced by said nozzle on a surface of said belt so as to form a web, nozzle oscillating means for oscillating said nozzle in a pattern of movement transverse to the direction of movement of said permeable belt, nozzle position sensor means for sensing the position of the nozzle along the pattern of movement, web sensor means downstream of said distribution chamber for detecting changes in the upper surface of said web and for generating signals in response to any such change, controller means including a closed electronic control system adapted for receiving a signal from said nozzle position sensor means and having parameters for the pattern of movement of said nozzle pre-programmed therein, said controller means being adapted for comparing the signals generated by said web sensor means with predetermined set points and for generating an output control signal with reference to said pre-programmed parameters of movement, and oscillator control means connected to said nozzle oscillating means and responsive to the output control signal generated by said controller means for controlling the pattern of movement of said nozzle so that the particulate material is distributed over the permeable belt to form a web having a predetermined grammage profile.

10. An apparatus according to claim 9 wherein the parameters of said pre-programmed pattern of movement of said electronic control system include parameters for centering the nozzle, controlling the angle of deflection of the nozzle, and a period of rest for said nozzle along the pattern of movement.

11. An apparatus according to claim 8 or 9 wherein said nozzle oscillating means comprises a shaft mounting the nozzle and a double-action hydraulic turning piston, and wherein said oscillator control means comprises hydraulic setting means including a hydraulic servo-valve, the movements of said servo-valve being actuated by said output control signals generated by said controller.

* * * * *